United States Patent [19]

Hooker

[11] 4,241,920

[45] Dec. 30, 1980

[54] AMUSEMENT APPARATUS

[75] Inventor: Donald E. Hooker, Wilmette, Ill.

[73] Assignee: Bally Manufacturing Corporation, Chicago, Ill.

[21] Appl. No.: 88,173

[22] Filed: Oct. 25, 1979

Related U.S. Application Data

[63] Continuation of Ser. No. 820,410, Aug. 1, 1977, abandoned.

[51] Int. Cl.[3] ..... A63F 5/04

[52] U.S. Cl. ..... 273/143 R

[58] Field of Search ..... 273/143 R, 143 A, 143 B, 273/143 C, 143 D, 143 E, 138 A

[56] References Cited

U.S. PATENT DOCUMENTS

| | | | |
|---|---|---|---|
| 2,193,478 | 3/1940 | Diebel | 273/138 A UX |
| 2,579,241 | 12/1951 | Nicolaus | 273/138 A X |
| 3,642,287 | 2/1972 | Lally et al. | 273/143 R |
| 3,733,075 | 5/1973 | Hooker et al. | 273/143 R X |
| 4,037,845 | 7/1977 | Hooker | 273/138 A |

FOREIGN PATENT DOCUMENTS

| | | | |
|---|---|---|---|
| 1292712 | 10/1972 | United Kingdom | 273/143 R |

*Primary Examiner*—Richard C. Pinkham
*Assistant Examiner*—Arnold W. Kramer
*Attorney, Agent, or Firm*—Fitch, Even, Tabin, Flannery & Welsh

[57] ABSTRACT

A slot machine type amusement apparatus having random control means for possibly advancing one or more drums bearing symbols a fractional turn following a playing cycle in which no winning combination of symbols was displayed and in which the control means was randomly actuated, so as to cause to be displayed a different combination of symbols, thereby according the player an additional opportunity to win a prize.

7 Claims, 11 Drawing Figures

35
38
51
50
49
48
47
46b
46a
45
44
43
42
41
40
39

62
68

66
65
70

61
59

51
44
50
43
49
42
48
41
47
40
46b
46a
39

56
81
52
81
53

56
53
52
54

AMUSEMENT APPARATUS

This is a continuation, of application Ser. No. 820,410, filed Aug. 1, 1977, and now abandoned.

BACKGROUND OF THE INVENTION

The present invention relates to an amusement apparatus of the type known as a slot machine.

Generally, the amusement apparatus of the present invention comprises a plurality of co-axially mounted rotatable drums, each bearing on its periphery a variety of symbols. Combinations of such symbols are displayed in a horizontal row within a viewing area. Different combinations of symbols have different predetermined play values. The drums are caused to be rotated by a player actuating a lever or depressing a starting button and, at the end of a normal play cycle, the drums are arrested by suitable electrical or mechanical means, with each drum displaying a symbol in the viewing area. Together these symbols form combinations in a horizontal row with certain ones being considered winning combinations, entitling the player to a reward or prize while certain other combinations are considered losing combinations. Heretofore, in amusement devices of the foregoing type, the drums when arrested and regardless of the combination displayed would remain in such condition until again caused to be actuated in the next succeeding play cycle.

It would substantially increase the amusement value of the device and player interest if, after the drums have been arrested, one or more of the drums automatically would be caused to rotate or to be advanced a predetermined fractional turn so as to display in the viewing area a different combination of symbols. Thus, if at the end of a normal cycle a losing combination were displayed, the player would have one or more chances of winning a prise by reason of the additional movement of one or more drums so as to cause to be displayed a new or different combination which may or may not be considered a winning combination. The game device would be conditioned so as not to advance any of the drums immediately after a winning combination of symbols were displayed.

SUMMARY OF THE INVENTION

One of the objects of this invention is the provision, in an amusement apparatus of the foregoing character, of means for automatically advancing one or more symbol carrying drums a predetermined fractional turn, after the end of a normal cycle, thereby according to a player another opportunity to win a prize or reward, if a losing combination of symbols originally were displayed.

Another object of this invention is the provision in an amusement apparatus of the foregoing character of means for enhancing the winning potential of a player and increasing the player interest.

Other and further objects and advantages of this invention will become apparent from the following detailed description and claims when read in connection with the accompanying drawings.

BRIEF DESCRIPTION OF A PREFERRED EMBODIMENT

Figure 1:
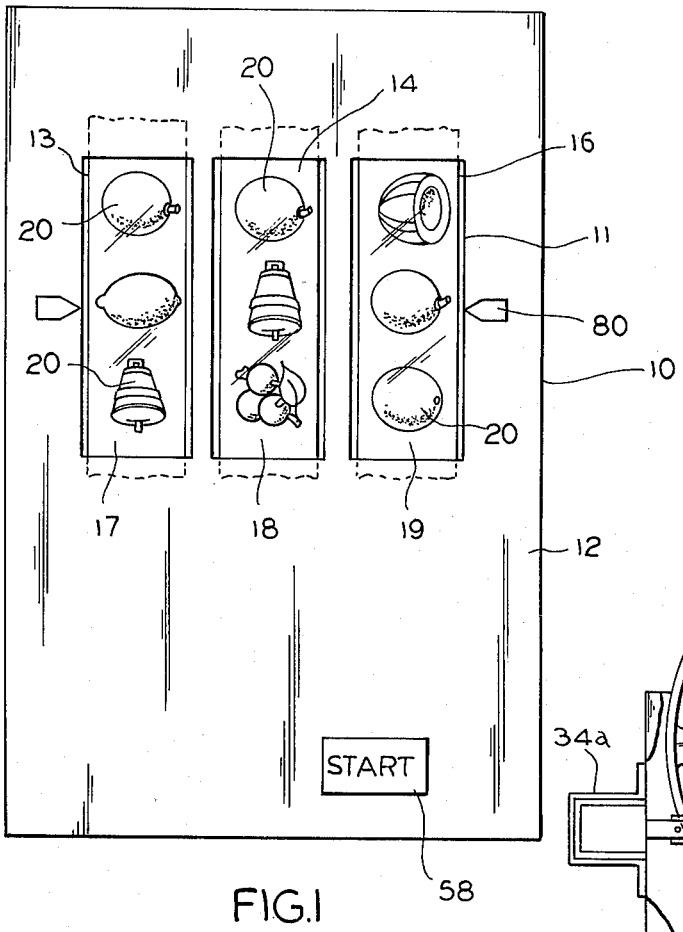
FIG. 1 is a front elevational view of an amusement apparatus embodying my invention.

The amusement apparatus embodying the present invention shown in FIG. 1 comprises mechanism housed within a console type cabinet 10 provided with a viewing area 11 on an upper portion of a front panel 12 of the cabinet. Preferably, the viewing area 11 is subdivided into three elongated rectangular viewing areas 13, 14 and 16. The mechanism contained within the cabinet includes three drums 17, 18 and 19 co-axially mounted in side by side relationship. Each drum includes a peripheral viewing surface on which are displayed a plurality of symbols 20. The drums 17, 18 and 19 are disposed in registration with respective viewing areas 13, 14 and 16 and, as illustrated in FIG. 1, preferably, three vertically aligned symbols are visible in each viewing area.

Figure 2:
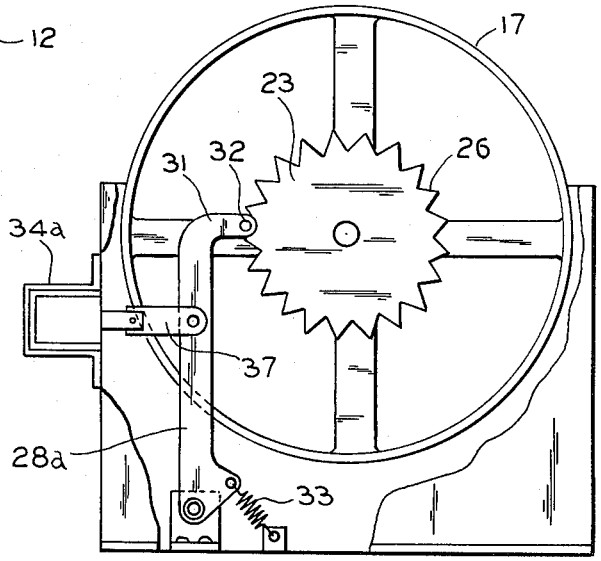
FIG. 2 is a fragmentary end elevational view of a drum bearing display signals, and associated mechanism.
Figure 3:
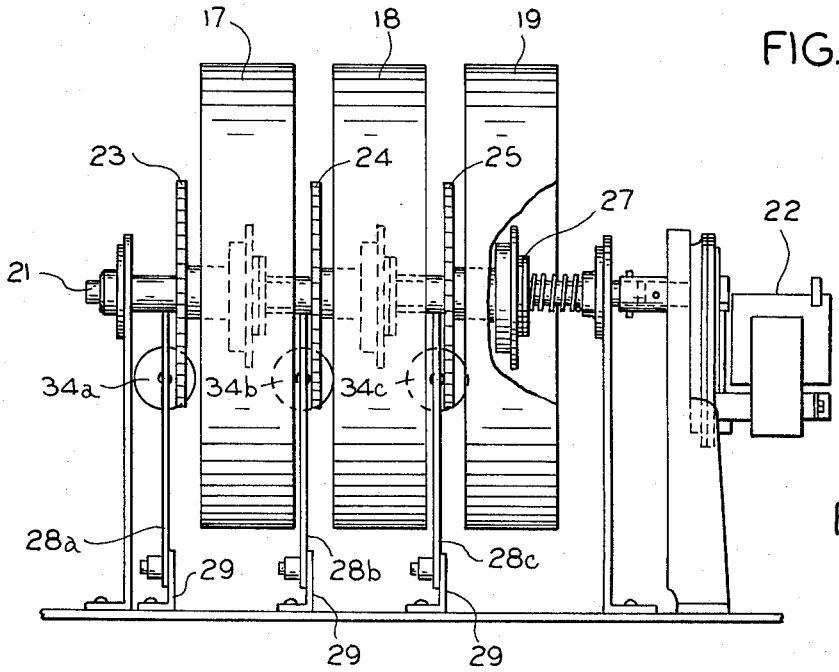
FIG. 3 is a fragmentary front elevational view of the drums and associated drive mechanism.

The drums 17–19 are rotatably mounted on a shaft 21 journalled in suitable bearings and operatively connected to an electric motor 22. Fixed to the hubs of drums 17, 18 and 19 are ratchet wheels 23, 24 and 25, respectively. The number of ratchet teeth 26 formed on each of the ratchet wheels corresponds to the number of symbols carried on the peripheral viewing area of a drum. Each drum includes a clutch mechanism 27 to effect driving engagement with the shaft 21. A plurality of pawls 28*a,b,c* are pivotally mounted at their lower ends on brackets 29 and each pawl is disposed in generally vertically registration with a respective ratchet wheel 23–25. The upper end of each pawl terminates in a lateral projection 31 carrying a roller 32 adapted to engage in the space between adjacent teeth 26 of a ratchet wheel. As seen in FIG. 2 each pawl is biased by a spring 33 in the direction of a respective ratchet wheel. Solenoids 34*a, b, c*, one for each pawl, 28*a, b, c*, are mounted on a suitable part of the frame and each has its armature connected to a pawl through a line 37. Normally, each solenoid 34*a, b, c*, is energized to maintain the roller 32 of a respective pawl out of engagement with the teeth 26 of the ratchet wheels 23–25. It will be apparent that when a solenoid 34*a, b, c*, is de-energized the spring 33 will cause a pawl 28*a, b, c*, to rock in a clockwise direction, as viewed in FIG. 2, to engage a ratchet wheel 23–25 and arrest movement of a drum 17–19.

Figures 4, 5, 6A, 6B, 8, 9, 10:
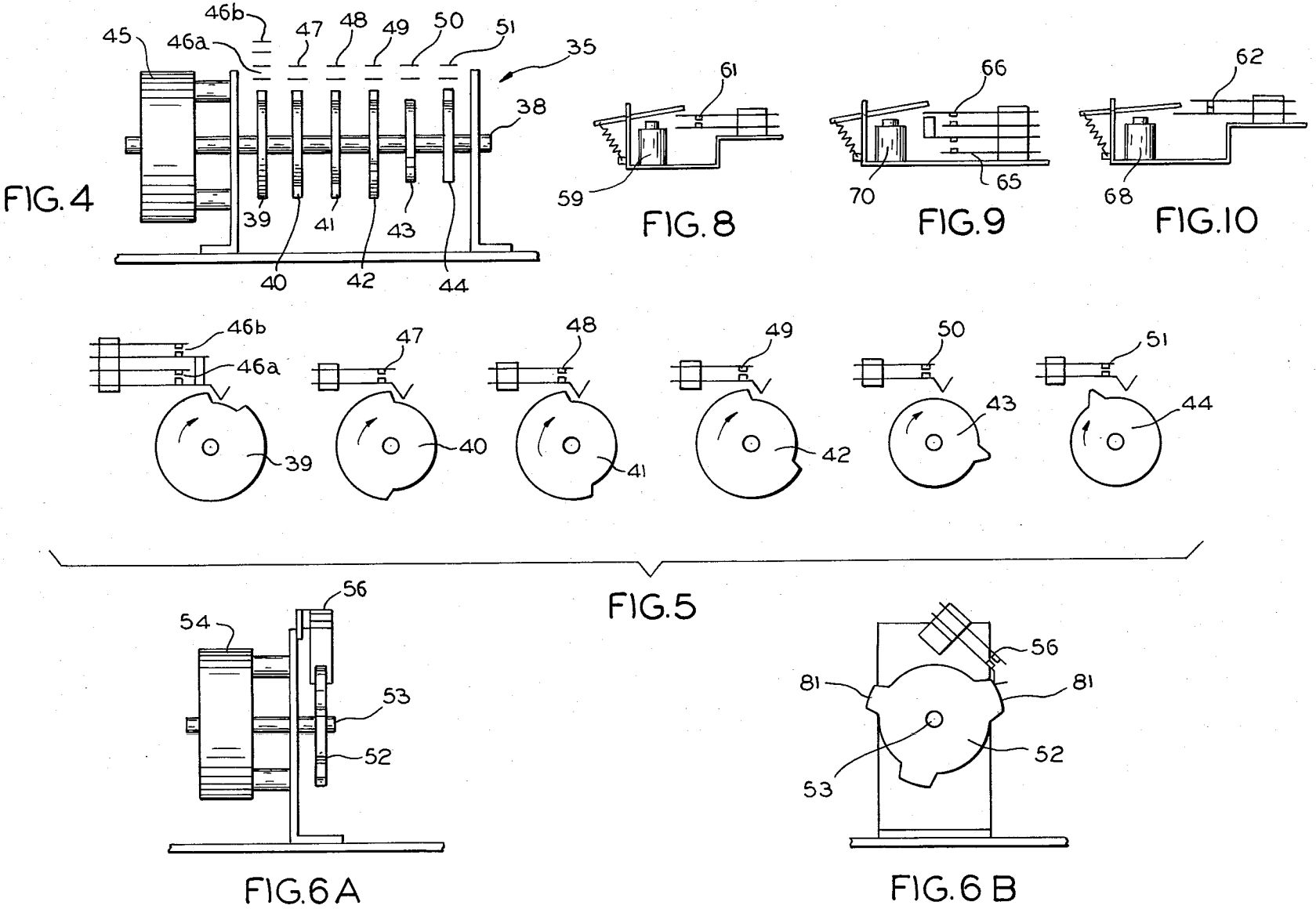
FIG. 4 is a front elevational view of the control cams, the driving means therefor and associated switches.
FIG. 5 is a schematic view of the control cams and associated switches illustrated in FIG. 4.
FIGS. 6*a* and 6*b* are respectively front and side elevational views of a control mechanism.
FIGS. 8, 9 and 10 are fragmentary elevational views of different relays and their associated switches.

Referring to FIGS. 4 and 5, the mechanism of the apparatus includes a control unit 35 comprising a cam shaft 38 journalled in suitable bearings supported on the frame. Fixed on the cam shaft 38 are a plurality of spaced cams 39–44, all arranged in a predetermined relationship. The shaft 38 is driven by an electric motor 45. The cams 39–44 have different configurations and each is intended to perform a different function, as will be hereinafter explained. Disposed in registration with the cams are a plurality of electrical switches 46–51, each adapted to be actuated by a respective cam.

Referring to FIGS. 6A and 6B, an independent cam 52 is fixed on shaft 53 which is journalled in a suitable bearing and driven by an electric motor 54. A switch 56 is disposed in registration with cam 52 and is actuated by said cam.

It will be understood that the present invention is intended to be utilized in an apparatus which includes conventional means, old in the art, for detecting a winning combination of symbols and prize awarding means controlled by the detecting means. For the sake of brevity and to avoid encumbering the specification, the detecting means and prize awarding means are illustrated in the form of boxes in FIG. 7 and identified by the letters A and B, respectively.

Figure 7:
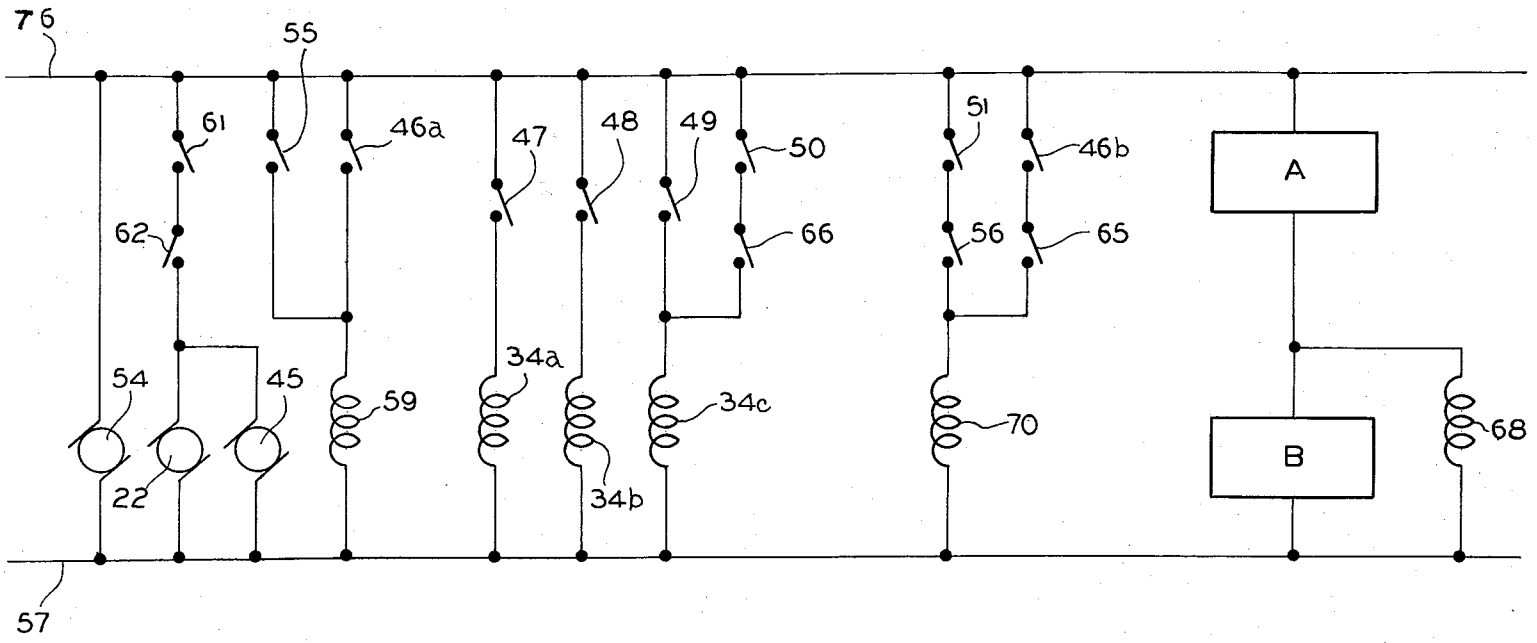
FIG. 7 is a schematic diagram of the electrical circuit of the apparatus related to the present invention.

The operation of the game apparatus will be best described by referring to the schematic diagram of the electrical circuitry illustrated in FIG. 7.

Motor 54 which rotates cam 52 is connected across electric supply lines 76 and 57 and operates continuously. A playing cycle is initiated by pressing the starter button 58 mounted on the front panel 12 of the cabinet. This button closes switch 55 effecting energization of relay 59 which closes switch 61. Switch 62 is arranged in series with switch 61 which switch 62 normally is closed as seen in FIG. 10. Control unit motor 45 and reel driving motor 22 arranged in parallel are thereby energized to rotate the series of control unit cams 39–44 and the drums 17–19, respectively. As cam 39 begins to rotate it immediately closes switch **46*a* which is in series with relay 59, causing relay 59 to remain energized until cam 39 completes substantially one revolution, after which relay 59 is deenergized, opening switch 61 and thereby arresting rotation of motors 22 and 45**.

As the several cams 39–44 of the control unit 35 make one complete revolution, the associated switches 46–51 control the operation of the game, as will be presently explained.

At the beginning of a playing cycle, cam 40 closes switch 47 which effects energization of solenoid **34*a* to withdraw pawl 28*a* from its associated ratchet wheel 23 permitting drum 17 to rotate. Cam 40 is designed to maintain switch 47 closed for substantially $\frac{3}{8}$ths of a revolution of the cam. Thus, drum 17 will continue to rotate for a time interval corresponding to $\frac{3}{8}$ths of a playing cycle. At such point cam 40 will disengage switch 47 causing the switch to open and effecting deenergization of relay 34*a* so that pawl 28*a* is effective to arrest rotation of drum 17**.

Similarly, cam 41 is designed to maintain switch 48 closed for $\frac{1}{2}$ of a revolution of the cam. While so closed drum 18 will rotate for an interval corresponding to $\frac{1}{2}$ of a playing cycle. When switch 48 is opened relay **34*b* is deenergized and pawl 28*b* is effective to arrest rotation of drum 18. Cam 42 is designed to maintain switch 49 closed for $\frac{5}{8}$ths of a revolution. Thus, drum 19 will rotate for an interval corresponding to $\frac{5}{8}$ths of a playing cycle, after which rotation of the drum 19 is arrested. At the end of a playing cycle, three symbols will be arranged in horizontal registration with the reference indicators 80 on the cabinet 10**.

Since the control unit motor 45 runs only during the playing cycle, whereas motor 54 runs continuously, the angular positions of their cams will have a randomly varying relationship. If switch 51 is pulsed by cam 44 at the same time that switch 56 is closed by cam 52, relay 70 will be energized. Switch 65 actuated by relay 70 will close, and since it is in series with switch **46*b* which is closed during this part of the game cycle, relay 70 will remain energized until the end of the game cycle, at which time switch 46*b*** opens.

Solenoid **34*c* is deenergized after $\frac{5}{8}$ths of the playing cycle. At $\frac{3}{4}$ths of the playing cycle, cam 43 will close switch 50 for a short time interval. If relay 70 has been energized and its associated switch 66 is closed, solenoid 34*c* will be energized during the time interval that switch 50 is closed, and drum 19 will be permitted to rotate during said time interval. Cam 43 is so shaped so that this time interval is just sufficient to cause drum 19** to progress to the next symbol.

Suitable means indicated by box A, and well known in the art, may be employed to detect a winning combination of symbols and to close an electrical circuit to a prize winning apparatus, indicated by box B, also well known in the art.

If a prize winning combination occurs, the prize winning apparatus (box B) will be connected to the power supply lines by box A and relay 68, connected in parallel with box B, will be energized, opening switch 62 and stopping motor 45 and the control unit cams.

When the prize awarding mechanism has finished its function, box B and relay 68 will be deenergized, switch 62 will close, and the play cycle will continue.

In the event that relay 70 had been energized and no prize winning combination had occurred so that relay 65 had not been energized nor switch 62 opened, the extra movement of drum 19 will now occur.

Thus, the player is accorded two opportunities to win a prize, in the event the first playing cycle has not produced a winning combination of symbols.

It will be understood that any movement of drum 19 following the completion of a playing cycle will depend on a random combination of circumstances which must occur simultaneously and that the fact of such occurrence is based on pure chance.

It will also be understood that it is within the purview of my invention to cause any one or more of the drums to be advanced one or more steps so as to display different combinations of symbols following a playing cycle.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. In an amusement apparatus having a plurality of rotating drums, each bearing a plurality of symbols, certain combinations of which have different play values and entitle a player to a reward, and including means for rotating said drums to initiate a playing cycle, means for arresting rotation of said drums before the end of a playing cycle to display a first combination of symbols, means for possibly effecting additional rotation of one of said drums during the playing cycle in which said first combination of symbols is not a winning combination so as to possibly cause to be displayed a second combination of symbols having a different play value, thereby according the player an additional opportunity to win a reward, said means for possibly effecting additional rotation being dependent upon said first combination of symbols not being a reward winning combination whereby said means for possibly effecting additional rotation of said one of said drums during the remainder of the playing cycle is dependent upon random means randomly actuating said means for effecting additional rotation during the said remainder of said playing cycle, whereby if the first combination of symbols is a reward winning combination the cycle is terminated and whereby if the first combination of symbols is not a reward winning combination and the random means is randomly actuated during the remainder of the playing cycle a second chance to win is afforded by said random means automatically actuating said one of said drums, the improvement comprising means for disabling said arresting means to permit additional rotation of one of said drums by said rotating means, first timing means operatively associated with a first switch means for closing said first switch means for at least one predetermined time interval at random times during the playing cycle, second timing means independent of said first timing means operatively associated with a second switch means for closing said second switch means for a predetermined time interval after the display of said first combination, and means for actuating said disabling means upon coincidental closing of said first and second switch means to cause to be displayed the second combination of symbols having a different play value, thereby according the player the additional opportunity to win a reward.

2. The apparatus as defined in claim 1 wherein said first timing means is a continuously driven cam which closes said first switch means for a small portion of the playing cycle and said second timing means is a cam which closes said second switch means for a small portion of the playing cycle at a fixed time within said playing cycle.

3. The apparatus of claim 2 wherein said means for rotating the drums, said first timing means, and said second timing means each comprises a separate motor.

4. The invention as defined in claim 1 in which the additional rotation comprises a fractional turn.

5. The invention as defined in claim 1 characterized by the provision of a motor driven cam shaft carrying a plurality of control cams having different configurations, with each cam being arranged to actuate a respective electrical control switch for controlling the operation of a respective drum, and an independently motor driven cam arranged to actuate an independent electrical switch, with the angular relationship of said control cams to said independent cam being randomly variable.

6. The invention as defined in claim 5 wherein the independent cam is continuously driven and the control cams are driven only during the interval of a playing cycle.

7. The invention as defined in claim 1 including means for detecting a winning combination of symbols and prize awarding means controlled by said detecting means.

* * * * *